US005536436A

United States Patent [19]

Pramod

[11] Patent Number: 5,536,436

[45] Date of Patent: Jul. 16, 1996

[54] LIQUID LAUNDRY DETERGENT COMPOSITIONS CONTAINING LIPOLYTIC ENZYME AND SPECIALLY SELECTED SOAPS

[75] Inventor: Kakumanu Pramod, West Chester, Ohio

[73] Assignee: The Procter & Gamble Company, Cincinnati, Ohio

[21] Appl. No.: 250,183

[22] Filed: May 27, 1994

[51] Int. Cl.[6] ..... C11D 8/32; C11D 1/12

[52] U.S. Cl. ..... 510/321; 510/284; 510/343; 510/481; 510/393; 510/341

[58] Field of Search ..... 252/132, 174.5, 252/368, 174.12, DIG. 12, 108

[56] References Cited

U.S. PATENT DOCUMENTS

| | | | |
|---|---|---|---|
| 3,676,338 | 7/1972 | Fries et al. | 252/8.75 |
| 3,853,781 | 12/1974 | Haschke et al. | 252/132 |
| 3,940,341 | 2/1976 | Gray et al. | 252/105 |
| 4,113,644 | 9/1978 | Ashcraft | 252/91 |
| 4,409,136 | 10/1983 | Cheng | 252/540 |
| 4,686,060 | 8/1987 | Crabtree et al. | 252/90 |
| 5,069,809 | 12/1991 | Lagerwaard et al. | 252/174.12 |
| 5,082,585 | 1/1992 | Hessel et al. | 252/174.12 |
| 5,292,448 | 3/1994 | Klugkist | 252/174.12 |

FOREIGN PATENT DOCUMENTS

| | | | |
|---|---|---|---|
| 4-323298 | 11/1992 | Japan | C11D 3/20 |
| WO94/12608 | 6/1994 | WIPO | C11D 10/04 |
| WO95/04807 | 2/1995 | WIPO | C11D 3/386 |

OTHER PUBLICATIONS

Hawley's Condensed Chemical Dictionary 12th ed. Revised by Richard J. Lewis, Sr., Van Nostrand Reinhold Co. New York 1993.

*Primary Examiner*—Paul Lieberman
*Assistant Examiner*—Necholus Ogden
*Attorney, Agent, or Firm*—Michael D. Jones; Jacobus C. Rasser; Jerry J. Yetter

[57] ABSTRACT

A liquid laundry detergent composition containing not more than 50% water by weight of the total liquid detergent composition, from about 0.0001 to about 1.0% on an active basis of a lipolytic enzyme, and further comprising a specially selected soap selected from the group consisting of specific $C_8$–$C_{24}$ secondary carboxyl materials; specific secondary carboxyl materials wherein the carboxyl substituent is on a ring hydrocarbyl unit; and specific $C_{10}$–$C_{24}$ primary or secondary carboxyl compounds and specific $C_{10}$–$C_{24}$ tertiary carboxyl compounds. A pretreatment laundering process using the composition is also disclosed.

18 Claims, No Drawings

LIQUID LAUNDRY DETERGENT COMPOSITIONS CONTAINING LIPOLYTIC ENZYME AND SPECIALLY SELECTED SOAPS

FIELD OF THE INVENTION

The present invention relates to aqueous, heavy duty liquid laundry detergent compositions containing a lipolytic enzyme (lipase) and specially selected soap. The compositions provide enhanced cleaning of grease/oil soils and stains, particularly when used in a pre-treat laundering process for cleaning fabrics stained with grease/oil soils.

BACKGROUND OF THE INVENTION

The detergent industry has a number of surfactant-related needs, including effective surface-active properties. The surfactants wet surfaces, reduce surface and interfacial tensions, disperse, solubilize and emulsify. All of these may be critical to the desired performance of the final detergent product. In addition, the increased use of liquid detergents and the complexity of these formulations increase the need for compatible surfactants and other detergent ingredients. Furthermore, the detergent ingredients need to be safe with respect to human exposure and long-term environmental impact.

It has been surprisingly found that the inclusion of specially selected soap materials into liquid detergent compositions containing a lipolytic enzyme (lipase) substantially enhances their ability to rapidly lower the interfacial tension of aqueous washing liquors containing greasy and oily soils. This substantial reduction of interfacial tension of greasy and oily soils improves their removal from soiled surfaces and inhibits the redeposition of the soils onto substrates.

It has also been suprisingly found that liquid detergent compositions containing a lipolytic enzyme and a specially selected soap material provide enhanced removal of greasy/oily soils particularly when the detergent composition is used in a pre-treatment application to greasy/oily soil stains on fabrics prior to and in conjunction with a normal wash process of the fabrics.

Moreover, it has been found that certain soaps, e.g. secondary alkyl carboxyls, not only provide the desired lowering of interfacial tension, with its attendant increase in grease removal performance, but also allow the formulation of liquid detergent compositions containing a lipase which are stable and homogeneous. In addition, it has been found that liquid detergent compositions comprising the specifically selected soaps are very useful when said lipase-containing liquid detergents are in direct contact with the greasy/oily satins and/or soils on fabrics such as during pretreatment.

SUMMARY OF THE INVENTION

The present invention encompasses aqueous, heavy duty liquid laundry detergent compositions comprising:

(a) not more than 50% water by weight of the total liquid detergent composition;

(b) from about 0.0001 to about 1.0% on an active basis of a lipolytic enzyme;

and further comprising a specially selected soap selected from the group consisting of:

A. $C_8$–$C_{24}$secondary carboxyl materials of the formula $R^3CH(R^4)COOM$, wherein $R^3$ is $CH_3(CH_2)_x$ and $R^4$ is $CH_3(CH_2)_y$, wherein y is an integer from 0 to 6, x is an integer from 4 to 20 and the sum of (x+y) is 4–20;

B. Secondary carboxyl materials wherein the carboxyl substituent is on a ring hydrocarbyl unit of the formula $R^5$-$R^6$-COOM, wherein $R^5$ is $C_7$–$C_{16}$ alkyl or alkenyl and $R^6$ is a ring structure;

C. $C_{10}$–$C_{24}$ primary or secondary carboxyl compounds of the formula $R^7CH(R^8)COOM$, wherein the sum of the carbons in $R^7$ and $R^8$ is 8–22, $R^7$ is of the form $CH_3$—$(CHR^9)_x$ and $R^8$ is of the form H—$(CHR^9)_y$, where x and y are integers in the range 0–15 and $R^9$ is H or a $C_{1-4}$ linear or branched alkyl group, provided at least one $R^9$ is not H; and D. $C_{10}$–$C_{24}$ tertiary carboxyl compounds of the formula $R^{10}CR^{11}(R^{12})COOM$, wherein the sum of the carbons in $R^{10}$, $R^{11}$ and $R^{12}$ is 8–22, and $R^{10}$, $R^{11}$ and $R^{12}$ are of the form $CH_3$—$(CHR^{13})_x$, wherein x is an integer in the range 0–19 and $R^{13}$ is H or a $C_{1-4}$ linear or branched alkyl group;

wherein in each of the above formulas A, B, C and D, the species M can be hydrogen or a water-solubilizing counterion.

The invention herein also encompasses a laundering pretreatment process for fabrics which have been soiled or stained with greasy/oily soils and/or stains said process comprising contacting said stains and/or soils with a highly concentrated form of the detergent composition set forth above prior to washing said fabric.

DETAILED DESCRIPTION OF THE INVENTION

Selected Secondary Soaps

The term "specially selected soaps" (a.k.a. "alkyl carboxyl surfactants") herein encompasses a soap selected from the groups consisting off A) $C_8$–$C_{24}$secondary carboxyl materials of the formula $R^3CH(R^4)COOM$, wherein $R^3$ is $CH_3(CH_2)_x$ and $R^4$ is $CH_3(CH_2)_y$, wherein y can be 0 or an integer from 1 to 10, x is an integer from 4 to 20 and the sum of (x+y) is 4–20, preferably 9–16, most preferably 11–14.

B) Carboxyl compounds wherein the carboxyl substituent is on a ring hydrocarbyl unit, i.e. secondary soaps of the formula $R^5$-$R^6$-COOM, wherein $R^5$ is $C_7$–$C_{16}$, preferably $C_{10}$–$C_{13}$, alkyl or alkenyl and $R^6$ is a ring structure, such as benzene, cyclopentane, cyclohexane and the like. (Note: $R^5$ can be in the ortho, meta or para position relative to the carboxyl on the ring).

C) $C_{10}$–$C_{24}$ primary and secondary carboxyl compounds of the formula $R^7CH(R^8)COOM$, wherein the sum of the carbons in $R^7$ and $R^8$ is 8–22, $R^7$ is of the form $CH_3$—$(CHR^9)_x$ and $R^8$ is of the form H—$(CHR^9)$y, where x and y are integers in the range 0–15 and $R^9$ is H or a $C_{1-4}$ linear or branched alkyl group. $R^9$ can be any combination of H and $C_{1-4}$ linear or branched alkyl group members within a single —$(CHR^9)$x,y group; however, each molecule in this class must contain at least one $R^9$ that is not H. These types of molecules can be made by numerous methods, e.g. by hydroformylation and oxidation of branched olefins, hydroxycarboxylation of branched olefins, oxidation of the products of Guerbet reaction involving branched oxoalcohols. The branched olefins can be derived by oligomerization of shorter olefins, e.g. butene, isobutylene, branched hexene, propylene and pentene.

D) $C_{10}$–$C_{24}$ tertiary carboxyl compounds, e.g. neo-acids, of the formula $R^{10}CR^{11}(R^{12})COOM$, wherein the sum of the carbons in $R^{10}$, $R^{11}$ and $R^{12}$ is 8–22. $R^{10}$, $R^{11}$ and $R^{12}$ are of the form $CH_3$—$(CHR^{13})_x$, where x is an integer in the range 0–19, and $R^{13}$ is H or a $C_{1-4}$ linear of branched alkyl group. Not that $R^{13}$ can be any combination of H and $C_{1-4}$ linear or branched alkyl group members within a single —$(CHR^{13})_x$ group. These types of molecules result from addition of a carboxyl group to a branched olefin, e.g. by the Koch reaction. Commercial examples include the neodecanoic acid manufactured by Exxon, and the Versatic™ acids manufactured by Shell.

In each of the above formulas A, B, C and D, the species M can be any suitable, especially water-solubilizing, counterion, e.g. H, alkali metal, alkaline earth metal, ammonium, alkanolammonium, di- and tri- alkanolammonium, C1–C5 alkyl substituted ammonium and the like. Sodium is convenient, as is diethanolammonium.

Formula C class soaps comprise secondary carboxyl compounds of the formula $CH_3(CHR)_k$—$(CH_2)_m$—$(CHR)_n$—$CH(COOM)(CHR)_o$—$(CH_2)_p$ —$(CHR)_q$—$CH_3$, wherein each R is $C_1$–$C_4$ alkyl, wherein k, n, o, q are integers in the range of 0–2, provided that the total number of carbon atoms (including the carboxylate) is in the range of 10 to 24.

Examples of preferred secondary soaps for use herein are water-soluble members selected from the group consisting of the water-soluble salts of 2-methyl-1-tetradecanoic acid, 2-ethyl-1-tridecanoic acid, 2-propyl-1-dodecanoic acid, 2-butyl-1-undecanoic acid; 2-pentyl-1-decanoic acid, 2-hexyl-1-nonanoic acid; 2-methyl-1-pentadecanoic acid; 2-hexyl-1-decanoic acid; 2-heptyl-1-undecanoic acid; 2-ethyl hexanoic acid; and mixtures thereof.

In a preferred embodiment the secondary soap is selected on the basis of product odor both in neat form and dilute aqueous solutions. Secondary soaps of the form $R^3CH(R^4)COOM$ in which the total carbon number is constant, odor improves as the length of the shorter alkyl chain ($R^4$) increases, e.g. 2-butyl-1-octanoic acid is preferred over 2-methyl-1-undecanoic acid. Similarly, secondary soaps in which $R^4$ is a fixed carbon number, the odor improves as the total carbon increases (i.e. $R^3$ increases). For example, 2-methyl-1-dodecanoic acid is preferred over 2-methyl-1-undecanoic acid.

The liquid detergent compositions according to the present invention containing such water-soluble special soaps exhibit quite low interfacial tensions, good grease removal properties.

Preferred selected soaps are $C_{15}$–$C_{18}$, The soaps can be employed in any water-soluble salt form, e.g. alkali metal, alkaline earth metals ammonium, alkanolammonium, dialkanol ammonium, trialkanol ammonium, 1–5 carbon alkyl substituted ammonium, basic amino acid groups, and the like; all of these counterions are well-known to manufacturers. The sodium salt form is convenient, cheap and effective. The acid form can also be used, but will usually be converted into the ionic form the pH adjustments which are made during processing of the compositions.

The selected secondary soaps employed herein to provide low interfacial tension and good greasy cleaning are those which contain a carboxyl unit connected to a secondary carbon. It is to be understood herein that the secondary carbon can be in a ting structure, e.g. as in p-decyl benzoic acid, or as in alkyl-substituted cyclohexyl carboxylates. The special soaps should contain no ether linkages, no ester linkages and no hydroxyl groups. There should be no nitrogen atoms in the head-group (amphiphilic portion). The special soaps usually contain 15–18 total carbon atoms, although slightly more (e.g. about 16–20) are preferred if the soap contains a ring structure, as noted above, e.g. p-decyl benzoic acid.

For purposes of illustration, and not by way of limitation, the special soaps based on the following secondary fatty acids produce low interfacial tension when used in the manner of this invention: 2-methyl-1-tetradecanoic acid, 2-ethyl-1-tridecanoic acid, 2-propyl-1-dodecanoic acid, 2-butyl-1-undecanoic acid; 2-pentyl-1-decanoic acid, 2-hexyl-1-nonanoic acid; 2-methyl-1-pentadecanoic acid; 2-hexyl-1-decanoic acid; 2-heptyl-1-undecanoic acid; p-decyl benzoic acid; and trans-4-decylcyclohexane carboxylic acid.

The inclusion of specially selected soap materials into the liquid detergent compositions substantially enhances their ability to rapidly lower the interfacial tension of aqueous washing liquors with greasy and oily soils. This substantial reduction of interfacial tension leads to improved removal of greasy and oily soils from surfaces and inhibits the redeposition of the soils onto substrates.

By "interfacial tension" ("IFT") herein is meant the tension measured at the oil/water interface. IFT measurements using the spinning drop technique, are disclosed by Cayias, Schechter and Wade, "The Measurement of Low Interfacial Tension via the Spinning Drop Technique", ACS Symposium Series No. 8 (1975) ADSORPTION AT INTERFACES, beginning at page 234. Equipment for running IFT measurements is currently available from W. H. Wade, Depts. of Chemistry and Chemical Engineering, the University of Texas at Austin, Austin, Tex. 78712.

Highly preferred secondary soaps are $C_{15}$–$C_{18}$ secondary soaps (the aforesaid numbers are intended to include the total carbon number including the carboxylate carbon atom in the special soaps), in that it has been found that $C_{15}$–$C_{18}$ secondary soaps when incorporated into the liquid detergents require substantial less of an amount of a suds suppressor compared to secondary soaps having less than 15 carbon atoms.

Typically, the liquid laundry detergent composition of the present invention comprises from 0.1 to 50%, preferably from 1 to 15%, most preferably from 2 to 10% of a specially selected soap by weight of the total detergent composition.

Lipolytic Enzyme

A second essential ingredient in the present laundry detergent compositions is a performance-enhancing amount, preferably from about 0.0001 to 1.0% on an active basis, of a detergent-compatible lipase (lipolytic enzyme). By "detergent-compatible" is meant compatibility with the other ingredients of the composition, particularly detergent surfactants and any detergency builders. Liquid detergent compositions, particularly heavy duty liquids, are preferred herein.

Any lipase suitable for use in a laundry detergent composition can be used herein. Suitable lipases for use herein include those of bacterial and fungal origin. Lipase from chemically or genetically modified mutants are included herein.

Suitable bacterial lipases include those produced by Pseudomonas, such as *Pseudomonas stutzeri* ATCC19.154, as disclosed in British Patent 1,372,034, incorporated herein by reference. Suitable lipases include those which show a positive immunological cross-reaction with the antibody of the lipase produced by the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with Amano-P antibody, using the standard and well-known immunodiffusion procedure according to Ouchterlony (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. lipolyticum FERM P 1338 (available under the trade name Amano-CES), lipases ex *Chromobacter viscosum*, e.g., *Chromobacter viscosum* var. *lipolyticum* NRRLB 3673, and further *Chromobacter viscosum* lipases, and lipases ex *Pseudomonas gladioli*. Other lipases of interest are Amano AKG and Bacillis Sp lipase.

Suitable fungal lipases include those producible by *Humicola lanuginosa* and *Thermomyces lanuginosus*. Most preferred is lipases obtained by cloning the gene from *Humicola lanuginosa* and expressing the gene in *Aspergillus oryzae* as described in European Patent Application 0 258 068, incorporated herein by reference, commercially available under the trade name Liplase™.

From about 2 to about 20,000, preferably about 10 to about 6,000, most preferably from about 200 to about 2000, lipase units per gram (LU/g) of lipase can be used in these compositions. A lipase unit is that amount of lipase which produces 1 μmol of titratable butyric acid per minute in a pH stat, where pH is 7.0, temperature is 30° C, and substrate is an emulsion of tributyrin, and gum arabic, in the presence of $Ca^{++}$ and NaCl in phosphate buffer.

Suprisingly, the specially selected soap materials herein do not inhibit the activity of the lipolytic enzyme. The compositions of the invention herein containing the lipase and soap material provide good cleaning of grease/oil soils particularly when used in a pre-treatment step during normal washing of fabrics containing said soils.

Fabric Laundering and Pretreatment Process

The present invention also provides a process for laundering fabrics soiled with greasy/oily stains or soil. Such a process employs contacting these fabrics with an aqueous washing solution formed from an effective amount of the detergent compositions hereinbefore described. Contacting of fabrics with washing solution will generally occur under conditions of agitation.

Agitation is preferably provided in a washing machine for good cleaning. Washing is preferably followed by drying the wet fabric in a conventional clothes dryer. An effective amount of the liquid or granular detergent composition in the aqueous wash solution in the washing machine is preferably from about 500 to about 7000 ppm, more preferably from about 1000 to 3000 ppm.

The detergent compositions herein may also be used to pretreat fabrics containing greasy/oily soils or stains prior to washing such fabrics using conventional aqueous washing solutions. Such pretreatment involves the application of highly concentrated forms of the detergent compositions herein directly onto the greasy or oily stains or soils found on the fabric to be cleaned. For compositions herein in liquid form, this will generally involve the direct application of the composition as is to the stain/soil on the fabric.

Pretreatment of greasy/oily stains or soils will generally occur for a period of from about 30 seconds to 24 hours prior to washing the pretreated soiled/stained substrate in conventional manner. More preferably, pretreatment times will range from about 1 to 180 minutes.

Suds Suppressor System

In addition to the specially selected secondary soap and lipolytic enzyme, the liquid detergent composition of the present invention preferably contains a suds suppressor system.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein (See U.S. Pat. No. 2,954,347). The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium and lithium salts, and ammonium and alkanolammonium salts.

The detergent compositions herein may also contain non-surfactant suds suppressors. These include, for example, high molecular weight hydrocarbons such as paraffin, fatty acid esters (e.g. fatty acid triglycerides), fatty acid esters of monovalent alcohols, aliphatic $C_{18}$–$C_{40}$ ketones (e.g. stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl dialkali metal (e.g. K, Na and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about –40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779. The hydrocarbons, thus, include aliphatic, alicyclic, aromatic and heterocyclic saturated or unsaturated hydrocarbons having from about 12 to about 70 carbon atoms. The term "paraffin", as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, and European Patent Application No. 89307851.9, published Feb. 7, 1990, by Starch, M. S.

Other silicone suds suppressors are disclosed in U.S. Pat. No. 3,455,839, which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672 and in U.S. Pat. No. 4,652,392.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (I) of siloxane resin composed of $(CH_3)_3SiO_{1/2}$ units of $SiO_2$ units in a ratio of from $(CH_3)_3SiO_{1/2}$ units and to $SiO_2$ units of from about 0.6:1 to about 1.2:1, and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The preferred primary silicone suds suppressor is branched/crosslinked.

To illustrate this point further, typical liquid laundry detergent compositions with controlled suds will optionally comprise from about 0.001 to about 1, preferably from about 0.01 to about 0.7, most preferably from about 0.05 to about 0.5 weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant, and (3) polyethylene glycol or a copolymer of polyethylene-polypropylene glycol having a solubility in water at room temperature of more than about 2 weight % and without polypropylene glycol. Similar amounts can be used in granular compositions, gels, etc. See also U.S. Pat. Nos. 4,978,471 and 4,983,316, 5,288,431 and 4,639,489 and 4,749,740.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol copolymer of polyethylenepolypropylene glycol.

The preferred silicone suds suppressors used herein do not contain polypropylene glycol, particularly of 4,000 molecular weight. They also preferably do not contain block copolymers of ethylene oxide and propylene oxide, like PURONIC L101.

Other suds suppressors useful herein comprise the secondary alcohols (e.g. 2-alkyl alkanols) and mixtures of such alcohols with silicone oils, such as the silicones disclosed in U.S. Pat. Nos. 4,798,679, 4,075,118 and EP 150 872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

When utilized mainly as suds suppressors, monocarboxylic fatty acids, and salts therein, will be present typically in amounts up to about 15% by weight of the detergent composition. Preferably from about 5% to about 15% of fatty monocarboxylate suds suppressor is utilized. In addition, the compositions herein will generally comprise from 0% to about 5% of suds suppressor. Silicone suds suppressors are typically utilized in amounts up to about 2.0% by weight of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Optional Detergent Ingredients

In another embodiment of the present invention, the liquid detergent composition may comprise one or more of a surfactant selected from a wide range of surfactants.

A typical listing of anionic, nonionic, ampholytic and zwitterionic classes, and species of these surfactants, is given in U.S. Pat. No. 3,664,961 issued to Norris on May 23, 1972.

Preferred anionic surfactants include the alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{18}$ alkyl component, more preferably a $C_{12}$–$C_{15}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{18}$ alkyl or hydroxyalkyl, more preferably $C_{12}$–$C_{15}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{15}$ alkyl polyethoxylate (1.0) sulfate ($C_{12}$–$C_{15}E(1.0)M$), $C_{12}$–$C_{15}$ alkyl polyethoxylate (2.25) sulfate ($C_{12}$–$C_{15}E(2.25)M$), $C_{12}$–$C_{15}$ alkyl polyethoxylate (3.0) sulfate ($C_{12}$–$C_{15}E(3.0)M$), and $C_{12}$–$C_{15}$ alkyl polyethoxylate (4.0) sulfate ($C_{12}$–$C_{15}E(4.0)M$), wherein M is conveniently selected from sodium and potassium.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

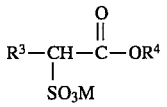

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2O)_k$—$CH_2COOM$+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface-Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 5% to about 25% by weight of such anionic surfactants.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–12 moles of ethylene oxide per mole of alcohol, particularly the $C_{12}$–$C_{15}$ primary alcohols containing 5–8 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

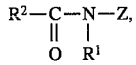

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH)CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid and citric acid.

Detergency builder salts are normally included in amounts of from 10% to 80% by weight of the composition preferably from 20% to 70% and most usually from 30% to 60% by weight.

Other components used in detergent compositions may be employed, such as enzymes and stabilizers or activators therefore, soil-suspending agents, abrasives, bactericides, tarnish inhibitors, coloring agents, foam control agents, corrosion inhibitors and perfumes. Especially preferred are combinations with enzyme technologies which also provide a type of color care benefit. Examples are cellulase for color maintenance/rejuvenation. Other examples are the polymers disclosed in EP 92870017.8 filed Jan. 31, 1992 and enzyme oxidation scavengers disclosed in EP 92870018.6 filed Jan. 31, 1992.

Also particularly suitable are amine base catalyst stabilizers disclosed in EP 92870019.4 filed Jan. 31, 1992.

Preferably the liquid compositions according to the present invention are in "concentrated form"; in such case, the liquid detergent compositions according to the present invention will contain a lower amount of water, compared to conventional liquid detergents. The level of water is less than 50%, preferably less than 30%, more preferably less than 20% of water by weight of the detergent compositions. Said concentrated products provide advantages to the consumer, who has a product which can be used in lower amounts and to the producer, who has lower shipping costs.

The following non-limiting examples illustrate the compositions of the present invention. All percentages, parts and ratios used herein are by weight unless otherwise specified.

EXAMPLES

Heavy duty liquid laundry detergent compositions are prepared by mixing the listed ingredients in the stated proportions in the order shown.

| Component | I | II | III |
|---|---|---|---|
| | Weight % | | |
| $C_{12}$—$C_{15}$ Alkyl sulfate | 7.0 | 7.0 | 7.0 |
| $C_{12}$—$C_{15}$ Alkyl ethoxylated (2.25) sulfate | 19.0 | 19.0 | 19.0 |
| $C_{12}$—$C_{14}$ N-methyl glucamide | 6.5 | 6.5 | 6.5 |
| $C_{12}$—$C_{14}$ fatty alcohol ethoxylate (9) | 6.5 | 6.5 | 6.5 |
| 2-methyl decanoic acid | 5.0 | 5.0 | 2.5 |
| Citric acid anhydrous | 3.0 | 3.0 | 3.0 |
| $C_{12}$—$C_{16}$ Fatty acid | — | — | 2.5 |
| Diethylene triamine penta methylene phosphonic acid | 0.94 | 0.94 | 0.94 |
| Propanediol | 10.7 | 10.7 | 10.7 |
| Ethanol | 4.4 | 4.4 | 4.4 |
| Monoethanolamine | 6.0 | 6.0 | 6.0 |
| Lipolase(LU/g) | 250 | 500 | 250 |
| Protease | 1.4 | 1.4 | 1.4 |
| Endo-A (5000 CEVU/g) | 0.05 | 0.05 | 0.05 |
| Cellulase[1] (Cevu/L) | 5 | 5 | 5 |
| Brightener | 0.75 | 0.75 | 0.75 |
| Boric acid | 4.5 | 4.5 | 4.5 |
| Water & Minors | up to 100% | | |

[1]Carezyme ™ (Novo Nordisk A/S)

The above liquid detergent compositions (I–III) were found to be very efficient in the removal of greasy/oily soils, particularly when used in a pre-treatment process.

What is claimed is:

1. A heavy duty laundry detergent composition comprising:

(a) not more than 50% water by weight of the total detergent composition;

(b) from about 0.0001 to about 1.0% on an active basis of a lipolytic enzyme;

(c) from about 10% to about 80%, by weight of the total detergent composition, of a builder which consists essentially of one or more water-soluble builders;

and further comprising a specially selected soap selected from the group consisting of:

A. $C_8$–$C_{24}$secondary carboxyl materials of the formula $R^3CH(R^4)COOM$, wherein $R^3$ is $CH_3(CH_2)_x$ and $R^4$ is $CH_3(CH_2)_y$ wherein y is an interger from 0 to 6, x is an interger from 4 to 20 and the sum of (x+y) is 4–20;

B. Secondary carboxyl materials wherein the carboxy substituent is on a ring hydrocarbyl unit of the formula $R^5$-$R^6$-COOM, wherein $R^5$ is $C_7$–$C_{16}$ alkyl or alkenyl and $R^6$ is a ring structure;

C. $C_{10}$–$C_{24}$ primary or secondary carboxyl compounds of the formula $R^7CH(R^8)COOM$, wherein the sum of the carbons in $R^7$ and $R^8$ is 8–22, $R^7$ is of the formula $CH_3$—$(CHR^9)_x$ and $R^8$ is of the formula H—$(CHR^9)_y$, where x and y are intergers in the range 0–15 and $R^9$ is H or a $C_{1-4}$ linear or branched alky group, provided at least one $R^9$ is not H; and D. $C_{10}$–$C_{24}$ tertiary carboxyl compounds of the formula $R^{10}CR^{11}(R^{12})COOM$, wherein the sum of the carbons in $R^{10}$, $R^{11}$ and $R^{12}$ is 8–22, and $R^{10}$, $R^{11}$ and $R^{12}$ are of the formula $CH_3$—$(CHR^{13})_x$, wherein x is an interger in the range 0–19 and $R^{13}$ is H or a $C_{1-4}$ linear or branched alkyl group;

wherein in each of the above formulas A, B, C and D, the species M can be hydrogen or a water-solubilizing counterion; and wherein said detergent composition is a liquid.

2. A liquid laundry detergent composition according to claim 1 wherein the soap is a $C_{15}$–$C_{18}$ secondary soap.

3. A liquid laundry detergent composition according to claim 1 wherein the soap is a member selected from the group consisting of acids or water-soluble salts of 2-methyl-1-tetradecanoic acid, 2-ethyl-1-tridecanoic acid, 2-propyl-1-dodecanoic acid, 2-butyl-1-undecanoic acid, 2-pentyl-1-decanoic acid, 2-hexyl-1-nonanoic acid, 2-methyl-1-pentadecanoic acid, 2-hexyl-1-decanoic acid, 2-heptyl-1-undecanoic acid, 2-ethyl hexanoic acid, and mixtures thereof.

4. A liquid laundry composition according to claim 1 wherein the lipolytic enzymes is a fungal lipase.

5. A liquid laundry composition according to claim 1 wherein the lipolytic enzyme is a lipase obtained by cloning the gene from *Humicola lanuginosa* and expressing the gene in *Aspergillus oryzae*.

6. The composition of claim 1 comprising from about 200 to about 2000 LU/g of the lipase.

7. The composition of claim 5 comprising from about 200 to about 2000 LU/g of the lipase.

8. The composition of claim 3 comprising from about 200 to about 2000 LU/g of the lipase.

9. A liquid laundry detergent composition according to claim 1 further comprising a suds suppressor system.

10. A liquid laundry detergent composition according to claim 2 further comprising a suds suppressor system.

11. A liquid laundry detergent composition according to claim 3 further comprising a suds suppressor system.

12. A liquid laundry detergent composition according to claim 9 wherein said suds suppressor system is selected from the group consisting of silicones, branched alcohols, linear fatty acids or mixtures thereof.

13. A liquid laundry detergent composition according to claim 11 wherein said suds suppressor system is selected from the group consisting of silicones, branched alcohols, linear fatty acids or mixtures thereof.

14. A liquid laundry detergent composition according to claim 1 further comprising surfactants, builders, enzymes and other conventional detergent ingredients.

15. A liquid laundry detergent composition according to claim 3 further comprising surfactants, builders, enzymes and other conventional detergent ingredients.

16. A liquid laundry detergent composition according to claim 13 further comprising surfactants, builders, enzymes and other conventional detergent ingredients.

17. A process for laundering fabrics soiled with greasy/oily stains and/or soils, which process comprises contacting such fabrics with an aqueous washing solution containing from about 0. 1% to 0.3% by weight of the detergent composition of claim 1.

18. A process for pretreating a fabric soiled with greasy/oily stains and/or soils, which process comprises contacting said stains and/or soils with a detergent composition according to claim 1 prior to washing said fabric.

* * * * *